United States Patent [19]

Kinase et al.

[11] 4,167,224

[45] Sep. 11, 1979

[54] ESCAPE CHUTE

[75] Inventors: Takeo Kinase; Katsuo Orii; Hiroaki Hosaka; Kiyoshi Ito, all of Sagamihara, Japan

[73] Assignee: Mitsubishi Denki Kabushiki Kaisha, Tokyo, Japan

[21] Appl. No.: 844,193

[22] Filed: Oct. 21, 1977

[30] Foreign Application Priority Data

Oct. 22, 1976 [JP] Japan ..... 51-142308[U]
Jun. 6, 1977 [JP] Japan ..... 52-73433[U]

[51] Int. Cl.[2] ..... A62B 1/20
[52] U.S. Cl. ..... 182/48; 193/25 R
[58] Field of Search ..... 182/48, 49; 193/25 R, 193/25 C, 25 A, 25 FT

[56] References Cited

U.S. PATENT DOCUMENTS

| | | | |
|---|---|---|---|
| 493,556 | 3/1893 | Murray | 182/48 |
| 1,754,375 | 4/1930 | Sturges | 182/48 |
| 3,433,323 | 3/1969 | Ukawa | 182/48 |
| 3,819,011 | 6/1974 | Kinase | 182/48 |
| 3,980,155 | 9/1976 | Campbell | 182/49 |

*Primary Examiner*—Reinaldo P. Machado
*Attorney, Agent, or Firm*—Oblon, Fisher, Spivak, McClelland & Maier

[57] ABSTRACT

An escape chute made up of a framework which can be horizontally projected outward from a building; a double tubular body having an inner cylinder and an outer cylinder made of cloth, and a spiral slide cloth forming a slide surface which is fixed between the inner cylinder and the outer cylinder; an upper entrance at the top and an exit at the bottom; one or more intermediate access apertures and intermediate entrance passages made of cloth to permit entrance into the space between the inner cylinder and the outer cylinder wherein the height of the lower edge of the intermediate access aperture is higher than the spiral slide surface at the position so as to prevent a part of a person from becoming hung up upon the aperture.

The intermediate entrance passages are held by ropes connected to the framework.

One or more intermediate exits are formed on the side surface of the bottom outer cylinder at higher than the exit.

4 Claims, 6 Drawing Figures

ESCAPE CHUTE

BACKGROUND OF THE INVENTION

1. Field of the Invention

The present invention relates to an escape chute which is equipped at an upper part of a high building having 3 to 10 floors so as to permit the escape of persons from the building in an emergency such as a fire or earthquake.

The escape chute of the present invention is located at a rooftop or a relatively upper part of the building so as to hang down from the building.

The body of the escape chute has double tubular inner and outer cylinders made of cloth and a spiral slide cloth which is sewed between the inner cylinder and the outer cylinder to form a spiral slide surface. In order to enter into the space between the inner cylinder and the outer cylinder of the escape chute on the spiral slide surface from intermediate floors, intermediate access apertures are formed on the side surface of the outer cylinder and the intermediate access apertures are constructed so as to permit safe escape.

2. Description of the Prior Art

It has been known to use a slide type escape chute which is positioned aslant from an emergency exit such as a window to the ground so as to permit persons to slide down and it has been also known to use an escape chute comprising a framework projected in a horizontal direction from the emergency exit of the building and a tubular body which is hung down from the framework so as to permit persons to slide down with means for controlling the falling speed of the persons. These escape chutes have been used in practice.

The former type slide is the same as a conventional slide whereby all kinds of persons such as old and young, male and female, can easily use it. However, it is deployed aslant whereby it is necessary to have a wide space around the building, and the bottom of the escape chute must be fixed on the ground so as to keep aslant.

The latter type escape chute requires only a small space. However, the descent passage is vertical whereby the feeling of diving into a deep hole is given, causing fear, whereby it is difficult to attain speedy escape, and the braking effect of the descent speed controlling means is variable depending upon the size of the persons.

On the other hand, in the field of the escape instruments of ships, it has been known to use escape instruments having a spiral slide surface as disclosed in U.S. Pat. No. 3,433,323, and which has been used in practice. The escape instruments have a slide surface for sliding down and are not held aslant whereby they are advantageous from the viewpoint of space. However, in these type escape instruments, an expandable air bag system is used whereby these escape instruments having an air bag system are not desirable as the escape instruments for burning buildings.

The inventors have considered, prepared, and studied various escape chutes made of cloth which have a spiral slide surface as the escape instrument in ships, but without any expandable air bag, as shown in FIG. 1.

The original escape chute will be illustrated referring to FIG. 1 wherein the reference numeral (1) designates a high building, (3) designates a framework which can be horizontally projected from a rooftop of the building (1) and (10) designates a body of the escape chute which is thrown down by an apparatus (not shown) to be held by the framework (3) and has an inner cylinder (11) made of cloth and an outer cylinder (12) made of cloth and has a spiral slide cloth (14) in the space between the inner and outer cylinders to form a slide surface. An upper entrance (15) is formed at the top of the slide cloth (14) and an exit (17) is formed at the bottom. Intermediate entrance tubular passages (20) are formed for entering from intermediate floors. One end of the intermediate entrance tubular passage (20) is sewed to connect it to the peripheral part of an aperture (18) which is formed at the side surface of the outer cylinder (12) corresponding to the window (2) in the intermediate floor. The other end of the intermediate entrance passage is fixed inside of the window of the building by various manners so as to form the passage.

Guide ropes (21) are disposed at the inner upper part of the intermediate entrance passage (20) with slack.

When the escape of persons is started in an emergency such as a fire in the building, the escape chute having the above-mentioned structure is thrown down to hang, and the intermediate entrance passages (20) are respectively fixed to the corresponding windows (2) as shown in FIG. 1, and the persons enter from the upper entrance (15) through the step type framework (3), or the persons pass through the intermediate entrance passages (20) from the windows (2) to reach the slide cloth (14) and slide on the slide cloth (14) to reach the exit (17) at the bottom and to escape.

However, the inventors have further studied and found the following disadvantages.

(i) A person sliding on the spiral slide cloth may become hung up at the intermediate access apertures.

(ii) An escape chute should be held away from the outer wall of a building so as to prevent the collision on the wall of the building. The intermediate entrance passages can not be connected to the corresponding windows in the intermediate floors in advance. Accordingly, the intermediate entrance passage is sometimes disposed in the opposite direction from the corresponding window because of the effects of wind etc. during development, whereby it takes a long time for disposing the intermediate entrance passage near the window and fixing it to the window. Sometimes, it is difficult to dispose the intermediate entrance passage near the window.

(iii) When an obstacle is disposed such as a parked automobile, or a raw material, a machine is left, or if a heavy snow is fallen on the ground below the escape chute, the bottom of the escape chute is received by the obstacle to form a slack part whereby the exit at the bottom is closed and the escape in an emergency is prevented.

SUMMARY OF THE INVENTION

It is an object of the present invention to overcome the abovementioned disadvantages which have been found by the inventor's studies.

Another object of the present invention is to provide an escape chute which has the improved feature that the lower edge of the intermediate access aperture is higher than the slide surface of the spiral slide cloth at the position so as to prevent the hang-up of a part of a person sliding on the slide surface. Another improved feature is that holding ropes are fixed to the framework to connect the intermediate entrance passages near the windows so as to easily fit the intermediate entrance passages to the corresponding windows, and the other improved feature is that one or more intermediate exits are formed on the outer cylinder at a point higher than the bottom the exit.

BRIEF DESCRIPTION OF THE DRAWINGS

A more complete appreciation of the present invention will be readily obtained as the same becomes better understood by reference to the following detailed description when considered in connection with the following drawings wherein.

DESCRIPTION OF THE PREFERRED EMBODIMENTS

Figure 1:
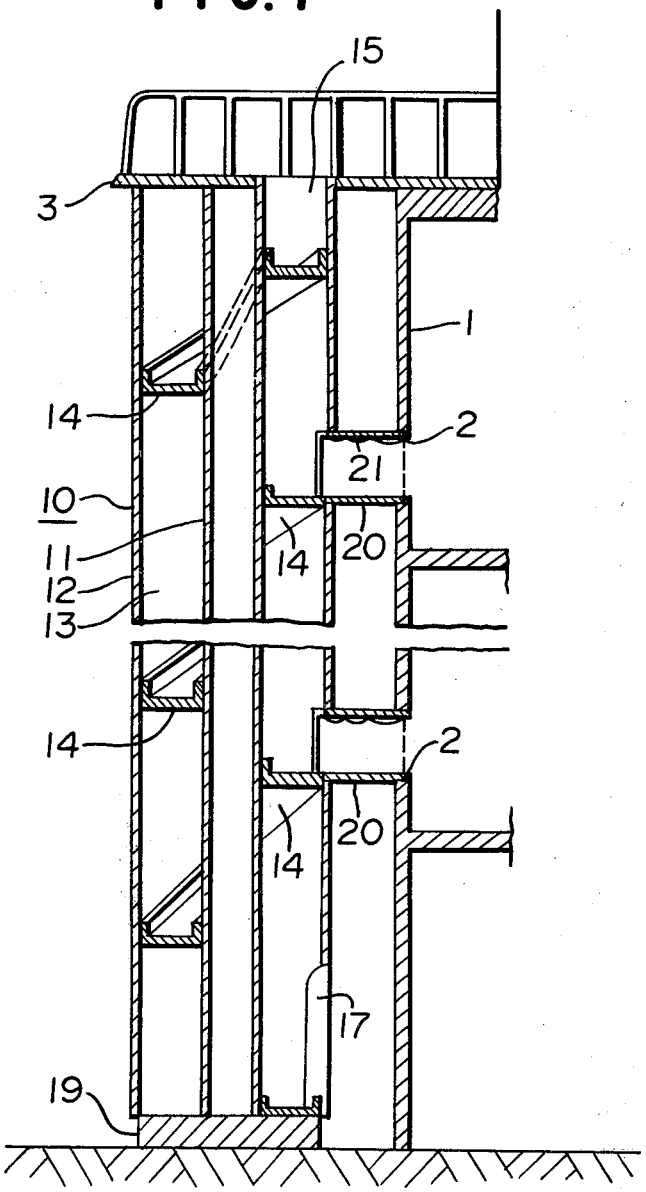
FIG. 1 is a schematic vertical sectional view of an escape chute.

Referring to the drawings, wherein like numerals designate identical or corresponding parts throughout the several views, one preferred embodiment of the escape chute according to the present invention will be illustrated.

Figure 2:
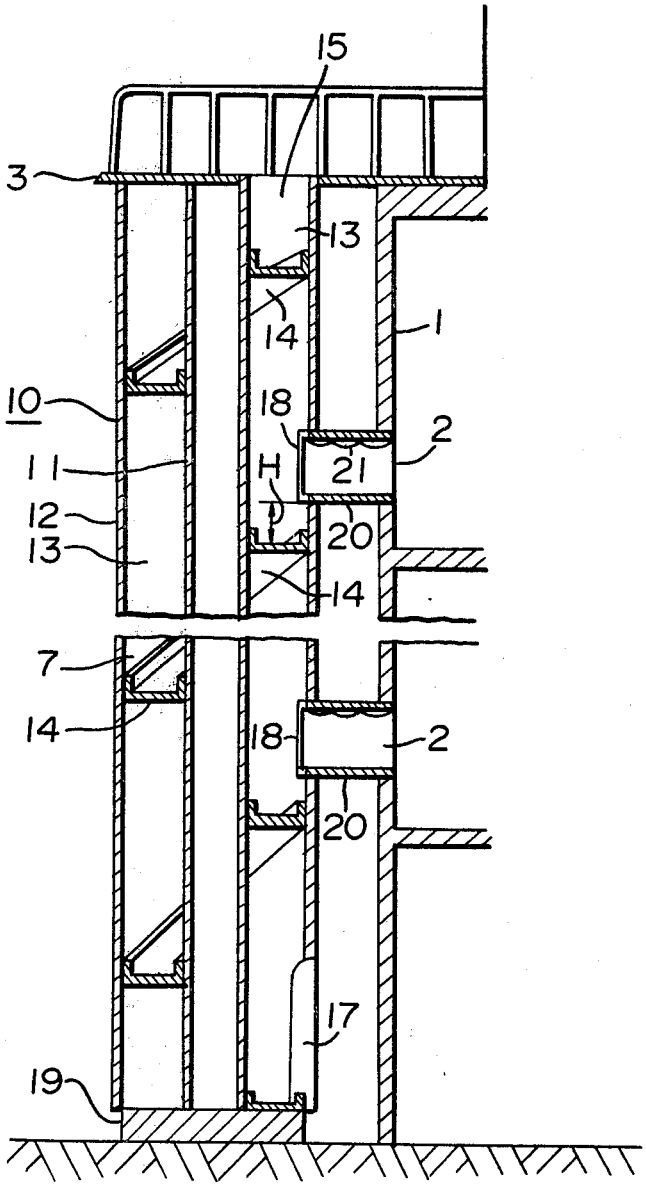
FIG. 2 is a schematic vertical sectional view of one embodiment of escape chute according to the present invention.

In FIG. 2, the reference numeral (1) designates a building; (2) designates windows in intermediate floors of the building; (3) designates a framework which is horizontally projected outward from the building (1) from a rooftop and which is foldable and held by a storage container (not shown) fixed on the rooftop and which is folded up and stored with the body of the escape chutes in the storage container, in the normal condition.

The body (10) of the spiral slideway type escape chute comprises an inner cylinder (11) made of cloth and an outer cylinder (12) made of cloth in a concentric annular state and a spiral slide cloth (14) connected in a space (13) between the inner cylinder and the outer cylinder so that the upper surface of the spiral slide cloth may be used as the slide surface. The body is fixed at the bottom of the framework (3) and is held by the framework in the deployed state shown in FIG. 2.

The reference numeral (15) designates an installation floor access aperture which is formed to permit entrance into the space (13) of the cylindrical body (10) from the framework (3) at the top of the escape chutes; and (17) designates an exit of the outer cylinder at the lower end of the body (10). The length of the body (10) is designed so as to contact the bottom of the body to the ground, when the escape chute is deployed. A buffer (19) is disposed at the bottom of the body.

The reference numeral (20) designates an intermediate entrance tubular passage made of cloth for entering into the cylindrical body (10) through the intermediate floor of the building and (18) designates an intermediate access aperture as an entrance which is formed at the side surface of the outer cylinder (12) corresponding to the window (2) on the intermediate floor. The lower edge of the aperture (18) is disposed higher than the slide surface of the slide cloth (14) with a predetermined step H, and one end of the intermediate entrance passage (20) is sewed together with the peripheral part of the aperture (18). The predetermined step H is given to prevent a part of person (leg or elbow) sliding on the slide surface to be caught by the aperture (18). The intermediate entrance and is more than 20 cm and may be as much as about 50 cm. When the step is more than ½ of the pitch of the slide cloth (14) (the pitch is about 3 m depending upon the height of a floor), the falling speed from the aperture (18) to the slide cloth (14) is too fast and the shock is too high.

Figure 3:
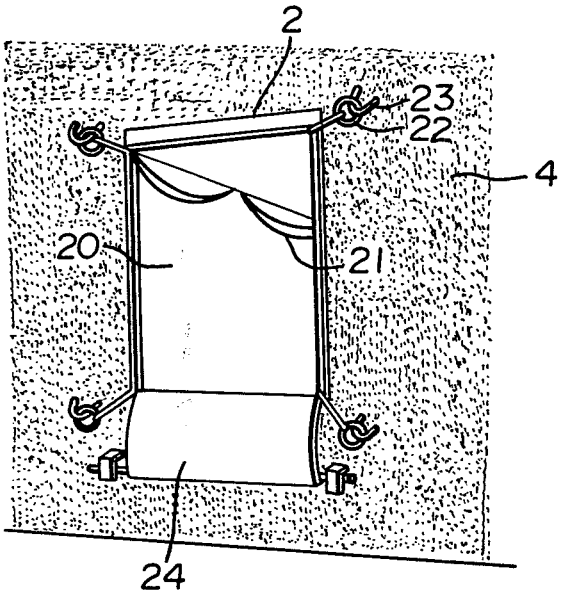
FIG. 3 is a schematic view showing the connection of an intermediate access aperture to a window.

As shown in FIG. 3, hooks (22) are connected at corners of the opposite end of the intermediate entrance passage (20) and the hooks (22) are fitted to holders (23) fixed on the wall of the room near the window of the building whereby the intermediate entrance passage (20) is fitted on the window (2). The reference numeral (24) designates an extended part of bottom of the intermediate entrance passage (20) which is fitted on the wall (4) of the room whereby the slack of the bottom of the passage caused by an entering person is reduced.

The escape chute of the present invention is deployed as the escape chute of FIG. 1 by throwing the body (10) down to hang and the intermediate entrance passages (20) are respectively connected to the windows (2). Persons enter through the upper entrance (15) or the intermediate entrance passages (20) into the space between the inner cylinder and the outer cylinder to slide on the slide cloth (14) and to reach the exit (17) at the lower end to escape.

In accordance with the present invention, the persons sliding on the slide cloth (14) can smoothly slide without trouble into entering the aperture (18) or being caught by the apertures (18) because of the predetermined step H, and the persons can quickly escape from the building.

Figure 5:
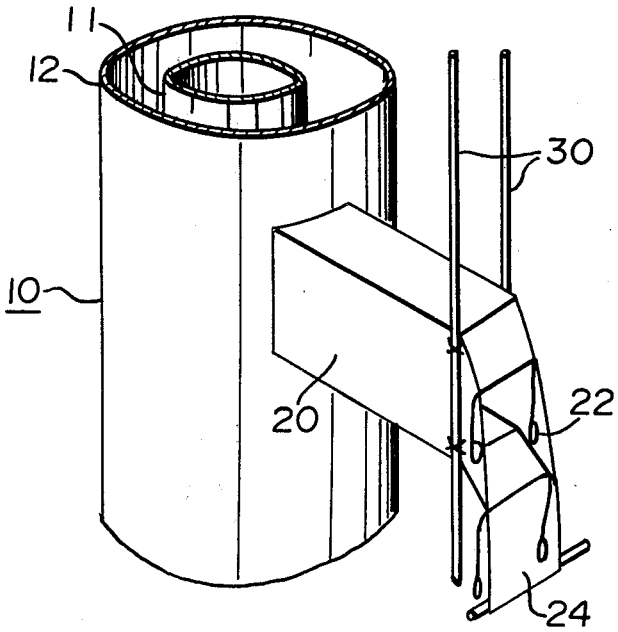
FIG. 5 is a schematic view of an intermediate access aperture of the escape chute of FIG. 4 in the condition of non-connection to a window.
Figure 4:
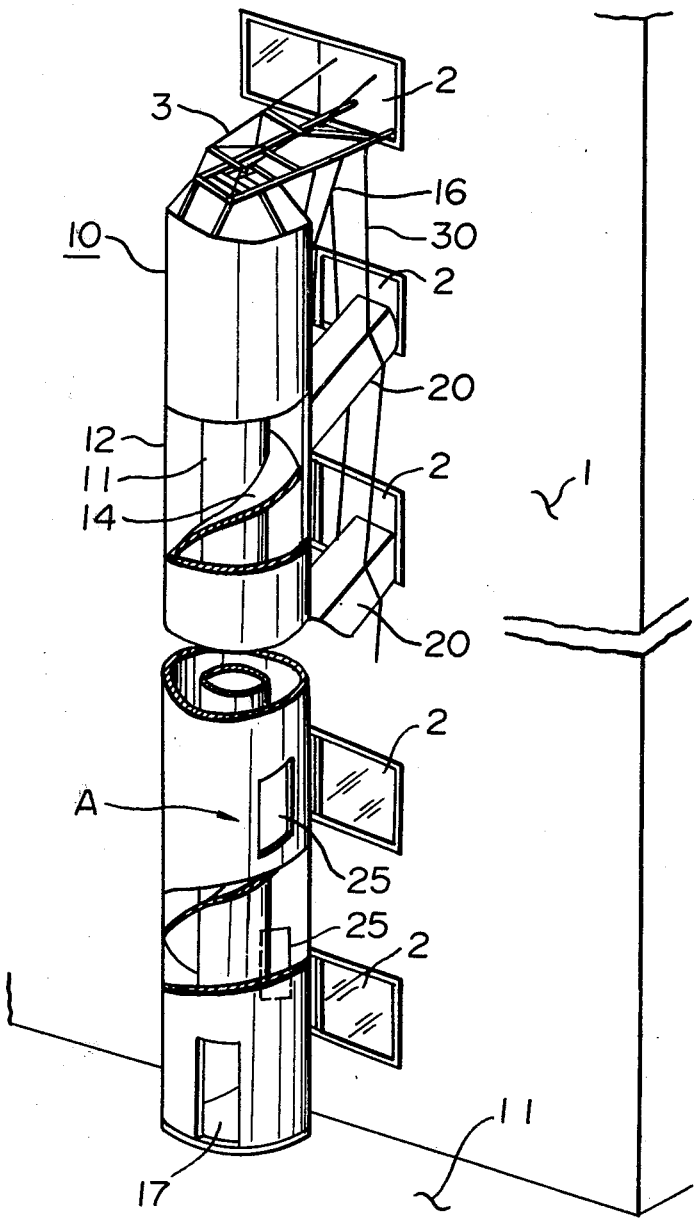
FIG. 4 is a schematic partially broken view of the other embodiment of the escape chute according to the present invention.
Figure 6:
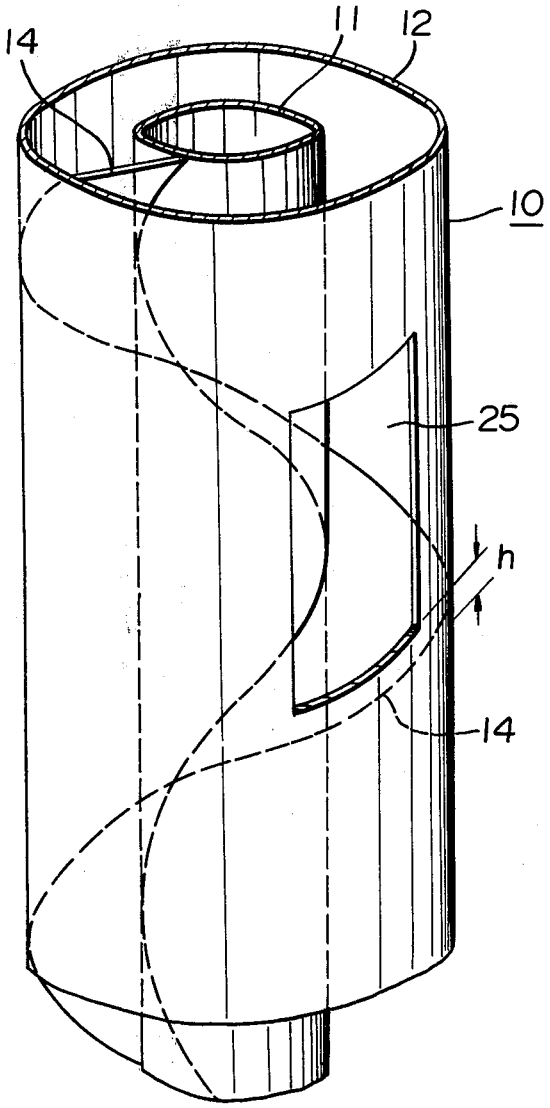
FIG. 6 is a partially enlarged view of the body of the escape chute of FIG. 4.

The other embodiment of the present inventions will be illustrated, referring to FIGS. 4 to 6 wherein like numerals designate identical or corresponding parts in FIGS. 1 to 3.

In the embodiment, the framework (3) is horizontally extended from the windows (2) of the building (1). At the top of the body (10) of the escape chute, the top entrance passage (16) is connected aslant from the hardware (3). The reference numeral (30) designates holding ropes whose upper edges are fixed on the hardware near the building and hung down, and the intermediate entrance passages (20) are respectively held by the ropes (30) near the windows. The reference numeral (25) designates one or more intermediate escape exits formed at the outer cylinder (12) at higher than the exit (17) at the bottom. The edge of the aperture of the exit (17) is disposed to be higher to provide the step h from the upper surface of the slide cloth (14). The aperture is closed by a cover, rope or tape with suitable fitting means such as a tape having both bonding surfaces or a tape having filamental hooks or hooks which can be disconnected by hands in the normal state. (not shown).

In accordance with the embodiment of the escape chute shown in FIGS. 4 to 6, when the escape chute is deployed to throw down the body, the intermediate entrance passages (20) are hung down by dead weight supported by the sewed part connected to the body, however the intermediate entrance passages near the windows are held by the holding ropes (30) whose tops are fixed on the framework (3), whereby the hang down of the passages (20) can be prevented as shown in FIG.

5. Moreover, it is possible to prevent the intermediate entrance passages from departed from the windows by twisting the body (10) when the body (10) is thrown down. In the case of heavy snow-fall, the bottom of the escape chute is put on the surface of the snow higher than the level of the ground and the exit (17) at the bottom can not be used because of the slackening of the tubular body. In this case, the persons can easily escape through the intermediate exit (25) near the surface. Obviously, many modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. An escape chute for a building comprising a framework connected to an upper part of the building; a chute body in the form of inner and outer concentric cloth cylinders which are adapted to be deployable so as to be vertically hangable from the said framework when in use; a cloth spiral slide surface fixed between said inner and outer cylinders; an upper entrance located adjacent the top of said outer cylinder; an exit located adjacent the bottom of said outer cylinder; at least one intermediate access aperture located at an intermediate portion of said outer cylinder; cloth intermediate entrance passages connecting each said access aperture to an aperture of the building; where said intermediate access apertures are located at a predetermined height above the point of contact of said spiral slide surface and said outer cylinder so that a person utilizing the chute will not become caught by the peripheral edge of the access opening.

2. An escape chute according to claim 1 wherein the lower edge of the intermediate access aperture is connected to the intermediate entrance passage which is fitted on a wall of a room and the lower edge of the aperture is higher than the spiral slide surface at the position in a step of more than 20 cm.

3. An escape chute according to claim 1 which further comprises one or more intermediate exits on the side surface of the outer cylinder at a level higher than the level of the bottom.

4. An escape chute according to claim 1 which further comprises holding ropes whose tops are fixed to the framework to be hung near the building so as to be accessible from a window, the free edges of the intermediate entrance passages being fixed to said holding ropes so as to also be disposed near the window.

* * * * *